US005671516A

United States Patent [19]

Sartori

[11] Patent Number: 5,671,516

[45] Date of Patent: Sep. 30, 1997

[54] EASY CONNECT AND RELEASE SEAT BELT BUCKLE

[76] Inventor: Robert C. Sartori, 1541 Kuhle Dr., Sun Prairie, Wis. 53590

[21] Appl. No.: 671,738

[22] Filed: Jun. 28, 1996

[51] Int. Cl.[6] ..... A44B 11/00

[52] U.S. Cl. ..... 24/652; 24/589; 24/616

[58] Field of Search ..... 24/652, 589, 702, 24/68 J, 71 J, 590, 588, 651, 653, 615, 616, 324, 662, 669

[56] References Cited

U.S. PATENT DOCUMENTS

| | | | |
|---|---|---|---|
| 796,414 | 8/1905 | Chayes . | |
| 1,807,293 | 5/1931 | Keller | 24/616 |
| 2,955,379 | 10/1960 | Hull | 16/122 |
| 2,956,324 | 10/1960 | Klein . | |
| 3,283,336 | 11/1966 | Critser | 24/652 |
| 4,001,924 | 1/1977 | Bengtsson | 24/615 |
| 4,008,513 | 2/1977 | Griffiths | 24/589 |
| 4,065,836 | 1/1978 | Stephenson . | |
| 4,100,657 | 7/1978 | Minolla . | |
| 4,648,161 | 3/1987 | Rosen . | |
| 5,088,163 | 2/1992 | van Riesen . | |
| 5,205,021 | 4/1993 | Durand | 24/163 R |

FOREIGN PATENT DOCUMENTS

| | | | |
|---|---|---|---|
| 1066710 | 6/1954 | France | 24/589 |
| 0457019 | 3/1928 | Germany | 24/702 |
| 0863556 | 3/1961 | United Kingdom | 24/589 |

*Primary Examiner*—Victor N. Sakran
*Attorney, Agent, or Firm*—Foley & Lardner

[57] ABSTRACT

A seat belt buckle system which is easy to engage and disengage includes a plunger section with a cylindrical plunger pin, mounted to a base, which is formed to fit closely within the bore of a receptacle forming part of a receptacle section. The receptacle section also includes a base to which a flexible seat belt can be connected. The buckle is engaged by inserting the plunger pin into a flared entrance end of the receptacle, which guides the leading end of the plunger pin into the bore of the receptacle. The plunger pin is held in place by the engagement of the pin to the internal walls of the receptacle and by engagement of a spring loaded detent ball against the side wall of the plunger pin, the end wall of the plunger pin or an indentation formed in the plunger pin. The bases of the receptacle section and plunger section can be modified to mate with the standard seat belt plunger plate and receiver of conventional seat belt systems to allow retrofitting of such systems.

22 Claims, 3 Drawing Sheets

EASY CONNECT AND RELEASE SEAT BELT BUCKLE

FIELD OF THE INVENTION

This invention pertains generally to the field of seat belt systems for automobiles and particularly to the buckles for such belt systems.

BACKGROUND OF THE INVENTION

Various designs have been developed and used for seat belt buckles for automobiles and other vehicles. The standard type of seat belt buckle now widely used on automobiles in the United States is an "aircraft" type seat belt buckle, which has a release button in one of the buckle sections which releases a plunger plate which had been inserted into that section. The spring loaded button on one of the buckle sections may be mounted at the end of the section adjacent to the position at which the plunger section is inserted, or in the middle of a side of the buckle section.

Many users of automotive seat belt buckles have experienced difficulties in engaging and disengaging the standard seat belt buckle sections. Insertion of the plunger section into the receiver is sometimes difficult and awkward because of the need to carefully position the plunger so it fits properly into the receiver section. If the plunger is not fully inserted it may not be completely engaged, defeating the purpose of the buckle. Particular difficulties are often encountered when an occupant of the vehicle is trying to release the buckle, since the spring loaded buttons may be difficult to reach or hard to operate. This problem is particularly severe for those individuals who are physically disabled or the elderly, since considerable force and manual dexterity may be required to operate the spring loaded buttons on conventional seat belt buckles.

SUMMARY OF THE INVENTION

In accordance with the present invention, a seat belt buckle is provided which has two sections, a plunger section and a receptacle section, which can be easily operated to engage the plunger section to or disengage the plunger section from the receptacle with an easy sliding motion that requires minimum hand strength and manual dexterity. The plunger section includes a base plate to which one of the seat belts is connected, and a cylindrical plunger pin mounted to an end of the base plate. The receptacle section includes a receptacle base plate, and a substantially cylindrical receptacle mounted to an end of the base plate which has an internal bore sized to receive the plunger pin with a fairly tight fit. A slot is formed in the wall of the receptacle to allow the plunger pin to be inserted into the bore of the receptacle, with the plunger base plate fitting in the slot so that the base plate does not interfere with the insertion of the pin into the receptacle. When the pin is fully inserted into the receptacle, the buckle is locked so that forces imposed by the seat belts in directions substantially perpendicular to the axes of the receptacle and the plunger pin are fully resisted by the engaged plunger pin and receptacle because the plunger pin cannot be pulled sideways out of the receptacle. However, when the occupant wishes to release the buckle, the plunger pin can be easily slid out of the bore of the receptacle as the occupant applies forces between the plunger section and receptacle section of the buckle in directions along the axes of the receptacle and plunger pin.

To facilitate insertion of the plunger pin into the receptacle, the open end of the receptacle is preferably flared outwardly away from its normal bore diameter (which fits tightly to the pin), so that the leading end of the plunger pin can be guided into the bore of the receptacle with minimum effort on the part of the occupant. To help secure the receptacle pin in place when it is within the receptacle, a spring loaded detent is provided to engage the pin to hold it releasably in place within the receptacle. The detent may comprise a spring loaded ball mounted to the receptacle which protrudes into the bore of the receptacle and either tightly engages the outer wall of the pin to provide frictional resistance to withdrawal of the pin from the receptacle or, preferably, engages with the end wall of the pin or with an indentation formed in the outer wall of the pin when the pin is fully inserted into the receptacle. Nonetheless, when the occupant wishes to release the belt buckle, the action of pulling the plunger section away from the receptacle section, with force exerted along the axes of the pin and receptacle, will move the spring loaded detent to allow the pin to be released from the receptacle without undue effort.

The invention further is adapted to be retrofitted to existing conventional seat belt buckle systems, such as the aircraft type buckle systems in which one of the buckle portions acts as a receiver. In such a case, one of the receptacle or plunger sections of the present invention has a plunger plate formed on the base thereof which properly mates with the receiver section of the conventional seat belt buckle system. The other of the receptacle or plunger sections may have a base which is formed to have slots therein which are adapted to have the flexible seat belt threaded therethrough to connect the buckle section to the seat belt, or, alternatively, the base may have a conventional aircraft type receiver section formed thereon to allow it to engage with the plunger of a conventional seat belt buckle. In either case, when the present invention is retrofitted to a conventional seat belt buckle system, the occupant does not need to operate the button of the conventional seat belt buckle to release the system, but rather disengages the seat belt buckle of the present invention utilizing the easy sliding motion of the plunger section away from the receptacle section.

Because, in the present invention, the engagement and disengagement of the buckle section is accomplished by an easy sliding motion, with no finger manipulation of a button required, the seat belt can be easily used by persons with physical disabilities or limited manual dexterity. For example, the two seat belt buckle sections in the present invention may be simply grasped by the two hands of the occupant, with engagement and release accomplished by a simple pulling motion of one of the hands away from the other.

Further objects, features and advantages of the invention will be apparent from the following detailed description when taken in conjunction with the accompanying drawings.

DETAILED DESCRIPTION OF THE INVENTION

Figure 1:
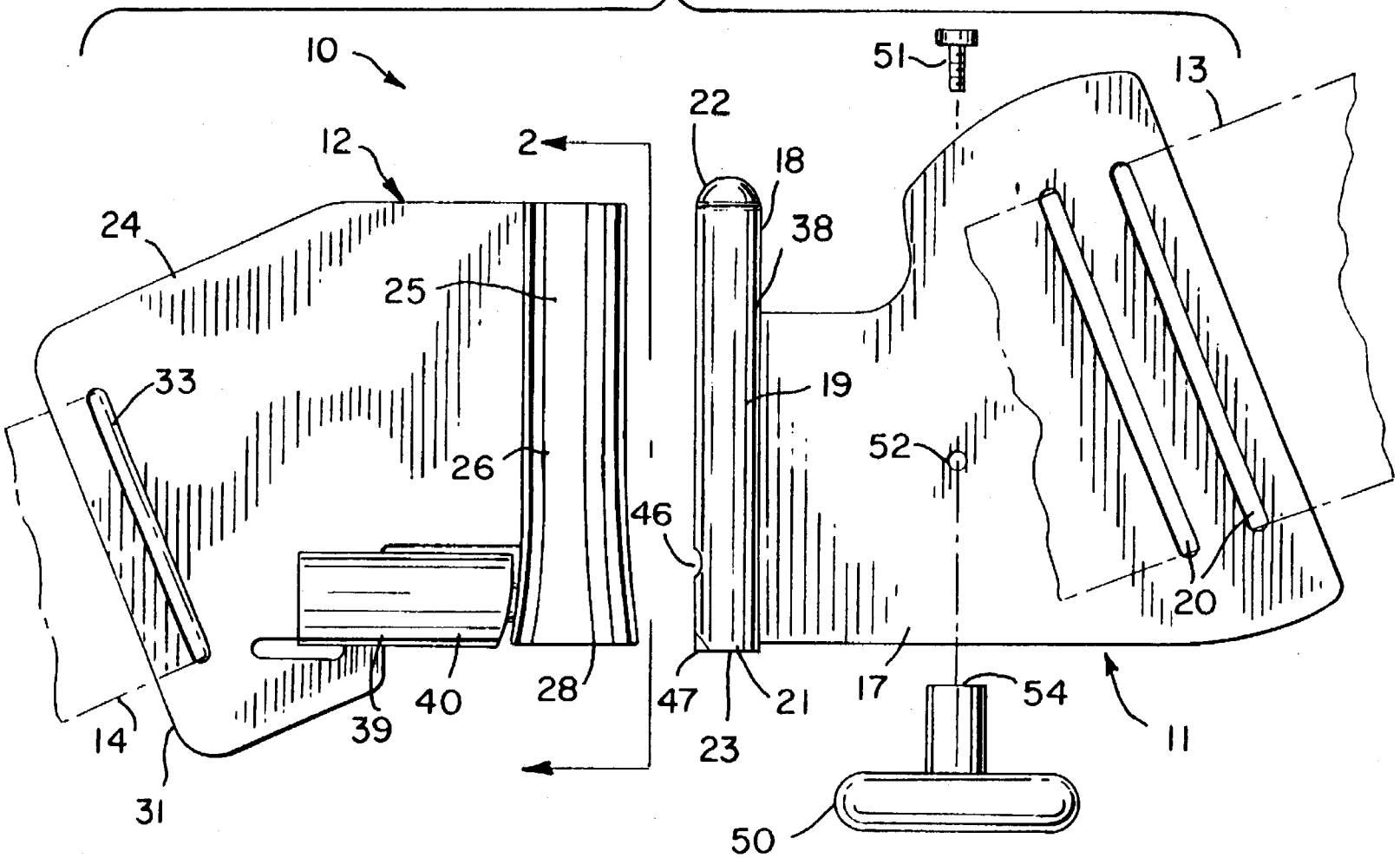
FIG. 1 is a plan view of the receptacle and plunger sections of the seat belt buckle of the present invention.

With reference to the drawings, the easy connect and release seat belt buckle of the present invention is shown generally at 10 in FIG. 1, comprising a plunger section 11 and a receptacle section 12. The plunger section 11 is connected to a flexible seat belt shown generally by the dashed lines labeled 13 in FIG. 1, and the receptacle section 12 is connected to a flexible seat belt indicated generally by the dashed lines labeled 14 in FIG. 1.

The plunger section 11 has a base 17 made of rigid sheet metal, such as steel, to which a cylindrical plunger pin 18 is secured along an edge 19 of the base 17. The plunger pin 18 may be attached to the base 17 integrally, for example, by being forged or cast together in one piece with the base 17, or may be welded to the edge 19 of a separately formed sheet metal base 17. To facilitate the attachment of the base 17 to a seat belt, slots 20 are formed in the base which are wide enough to allow a typical flexible seat belt to be threaded thereto to secure the plunger section to the belt 13 at an adjustable position on the belt 13 in a conventional manner. The plunger pin 18 is preferably formed of a solid cylindrical piece of metal (e.g., steel) having a cylindrical outer periphery 21 which is substantially greater in diameter than the thickness of the sheet metal base 17, and which terminates in a rounded or tapered leading end 22. The plunger pin 18 preferably has a flat trailing end 23 as shown in FIG. 1. As shown in FIG. 1, the slots 20, by which the base 17 of the plunger section is secured to the seat belt 13, are preferably formed to lie at an angle to the axis of the plunger pin 18, with the angle between the slots 20 and the axis of the plunger pin 18 preferably converging toward the leading edge 22 side of the plunger pin 21. Consequently, when force is exerted on the plunger section 11 by the seat belt 13 (e.g., during a crash or a sudden stop), the force of the seat belt functions to draw the plunger pin 18 further into the receptacle section as explained further below.

Figure 3:
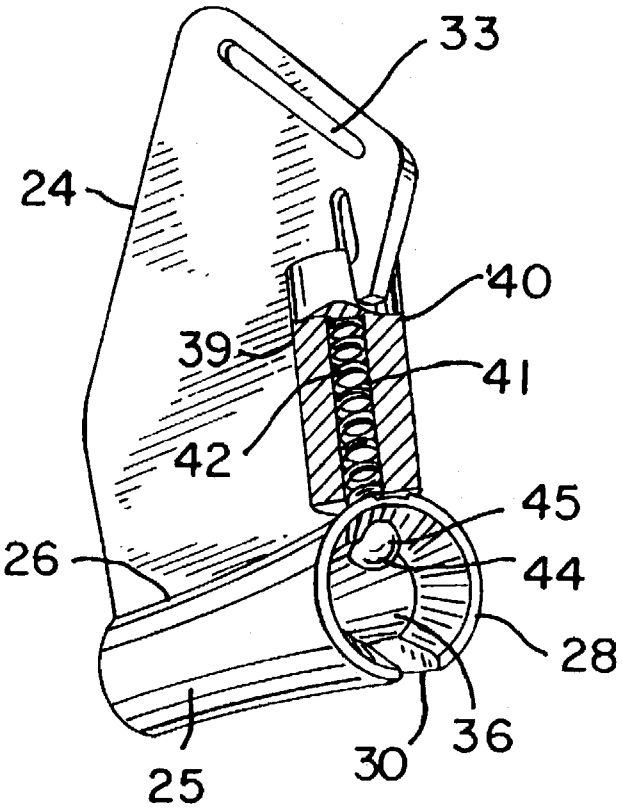
FIG. 3 is a perspective view of the receptacle section of the buckle of the present invention, illustrating the bore of the receptacle section and the spring loaded detent ball mounted therein.
Figure 2:
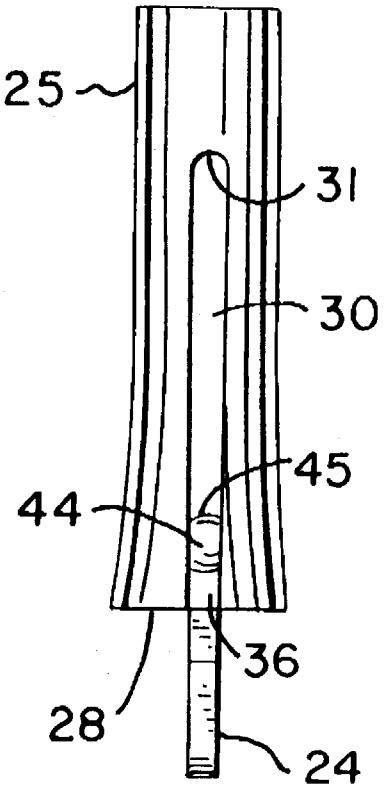
FIG. 2 is an elevation view of the receptacle section of the seat belt buckle of the invention, generally viewed along the lines 2—2 of FIG. 1.

The receptacle section 12 has a base 24 formed of rigid sheet metal (e.g., steel) to which is attached a cylindrical hollow receptacle 25 at an inner edge 26 of the base 24. The receptacle 25 may be formed integrally with the base 24—for example, by being formed of the same sheet metal as the base 24 but forged or bent to form a cylindrical hollow structure—, or the receptacle 25 may be formed separately from the base 24 and secured to it by, for example, welding the receptacle 25 to the edge 26 of the base 24. The receptacle 25 has a preferably flared entrance end 28, into which the leading end 22 of the pin 18 is inserted, and, as shown in FIG. 2, a slot 30 is formed in the wall of the receptacle 25 extending from the receptacle open end 28 to a terminal end 31 of the slot. The slot 30 is formed in the receptacle 25 at a position preferably directly opposite the position at which the receptacle is connected to the edge 26 of the base 24. The base 24 has a slot 33 formed therein, preferably near its outer edge 34, through which the flexible seat belt 14 is threaded. The seat belt 14 typically has an expanded end portion (e.g., a folded over and sewn together section of the seat belt), or the seat belt 14 is passed through the slot 33 and sewed back to itself, to, in either event, secure the seat belt 14 in a fixed position to the base 24 of the receptacle section 12. The slot 33 is preferably oriented at an angle to the central axis of the interior bore 36 (shown in FIG. 3) of the receptacle 25. The slot 33 is oriented at an angle that intersects with the axis of the cylindrical receptacle 25 on the side of the open end 28 of the receptacle, so that when force is applied by the belt 14 to the receptacle section, the receptacle 25 will be drawn against a plunger pin 18 inserted into the bore of the receptacle 25 so as to bring these two elements into tighter engagement.

The outside diameter of the cylindrical plunger pin 18 is preferably selected to closely match and be slightly smaller than the inside diameter of the bore 36 of the receptacle 25, so that a fairly tight engagement occurs between these two structures when the pin 18 is inserted into the bore of the receptacle 25. The thickness of the metal base 17 is selected to be less than the width of the slot 30 in the receptacle 25, so that the pin 18 can be inserted into the bore 36 of the receptacle without interference by the base 11. The diameter of the plunger pin 18 is substantially greater than the width of the slot 30, so that the pin 18 cannot be pulled through the slot 30 no matter how much force is exerted between the plunger section 11 and the receptacle section 12. As shown in FIG. 1, the pin 18 preferably has a portion near its leading end 22 which extends beyond the adjacent edge 19 of the base 17 to which it is attached, and, thus, when the pin 18 is inserted into the bore 36 of the receptacle, the portion of the pin 18 beyond the position 38 at which the connection of the edge 19 to the pin terminates will be held within the receptacle 25 entirely surrounded by the cylindrical metal of the receptacle. Consequently, the pin 18 is held very securely within the receptacle 25 so that the buckle cannot fail by virtue of the pin being pulled out of the receptacle 25 through the slot 30.

To further hold the pin 18 in position when it is engaged within the bore of the receptacle 25, a spring loaded detent mechanism 39 may be utilized. The detent mechanism 39 includes a cylindrical case 40 with an internal chamber (shown in dashed lines at 41 in FIG. 3) within which is mounted a spring 42 (shown in FIG. 3). The spring 42 is compressed and provides spring pressure to a ball 44 which sits in an opening 45 in the bore 36 of the receptacle. The opening 45 in the bore 36 is slightly smaller than the diameter of the ball 44 so that the ball 44 is held in the opening 45 partially extending into the bore 36 of the receptacle. When the plunger pin 18 is inserted into the bore 36 of the receptacle, the ball 44 will be pushed aside and will exert pressure on the pin 18, providing additional frictional restraint of the pin from releasing accidentally from the receptacle. A preferred arrangement for positively holding the pin in place is to select the length of the pin so that the ball 44 is released by the pin 18 when the pin is fully inserted in the receptacle 25, with the ball 44 then holding the pin in place by engaging the trailing end wall 23. This arrangement also has the advantage that the ball 44 will make an audible snap when it is released by the pin, assuring the user that the pin is fully engaged. A bevel 47 is preferably provided between the side wall 21 and the end wall 23 to make it easier for the user to withdraw the pin from the receptacle when the buckle is to be released. The bevel 47 is positioned to engage the detent ball 44 and push the ball inwardly against the force of the spring. Alternatively, if desired, a slight indentation 46 may be formed in the outer surface of the plunger pin 18 at a position such that when the plunger pin 18 is fully inserted within the receptacle 25 (at a point where the edge 38 of the base engages the terminal end 31 of the slot 30), the ball 44 will fit into the indentation 46. The engagement between the spring loaded ball 44 and the end wall 23 or the wall of the indentation 46 securely holds the plunger pin 18 within the bore of the receptacle 25 so that the plunger will not accidentally fall out under the force of gravity or be dislodged through movement of an occupant of the vehicle.

If desired, a handle 50 may be attached to the base plate 17 (e.g., by means of a screw 51 threaded through a hole 52 into a threaded bore 54 in the end of the handle 50). A similar handle may be attached to the base 24 of the receptacle section.

To use the buckle 10, the occupant using the seat belt grasps the buckle sections 11 and 12 or the handle 50 using the full grip of each hand to hold a respective buckle section by the base 17 (for the plunger section) or the base 24 (for the receptacle section) or by the hundie(s) 50. The occupant then moves the plunger section to insert the leading end 22 of the plunger pin into the flared entrance end 28 of the receptacle 25, which guides the leading end 22 into the bore 36 of the receptacle, and then slides the plunger pin 18 into the receptacle until the edge 38 of the plunger base 17 engages the terminal end 31 of the slot 30. At this point, the plunger pin 18 is fully inserted into the receptacle, and the spring loaded ball 44 should be engaged with the wall of the indentation 46 or the back wall 23 (or the wall of the bevel 47). The seat belt is now securely held in place. Because of the angled orientation of the slots 20 by which the seat belt 13 is connected to the plunger section 11, and the orientation of the slot 33 by which the seat belt 14 is connected to the receptacle section 12, when force is applied between the seat belts 13 and 14, the plunger pin 18 tends to be driven into the receptacle 25 so that the pin and receptacle remain firmly engaged with no chance that the pin will be withdrawn from the receptacle under such circumstances.

When the occupant wishes to disengage the seat belt, the bases of the receptacle section and plunger section, or the handle(s) 50, may then be grasped by the hands of the occupant and the buckle released by a simple sliding motion, drawing the receptacle section away from the plunger section through the simple action of pulling the two sections away from each other along the axes of the plunger pin and receptacle. Because the occupant can use his or her entire hand to grasp the receptacle base 24 and the plunger base 17, or the handle 50, even individuals with physical disabilities or weaknesses can easily disengage the belt sections. The buckle sections may be readily disengaged from one another with only one hand by appropriately using a thumb of the one hand to push the end 22 of the receptacle downwardly while holding the base 17 of the plunger section with the other fingers of the hand.

Furthermore, in using the present invention, the occupant can easily see and understand how the plunger pin 18 is to fit into the receptacle 25 in order to lock the buckle in place, since the structure is open and accessible and the physical principles involved are readily understood. Similarly, the present invention has the advantage that the disengagement of the two buckle sections is also easily understood as involving simply pulling the two sections of the buckle apart—a simple, obvious action which is easily accomplished.

Figure 4:
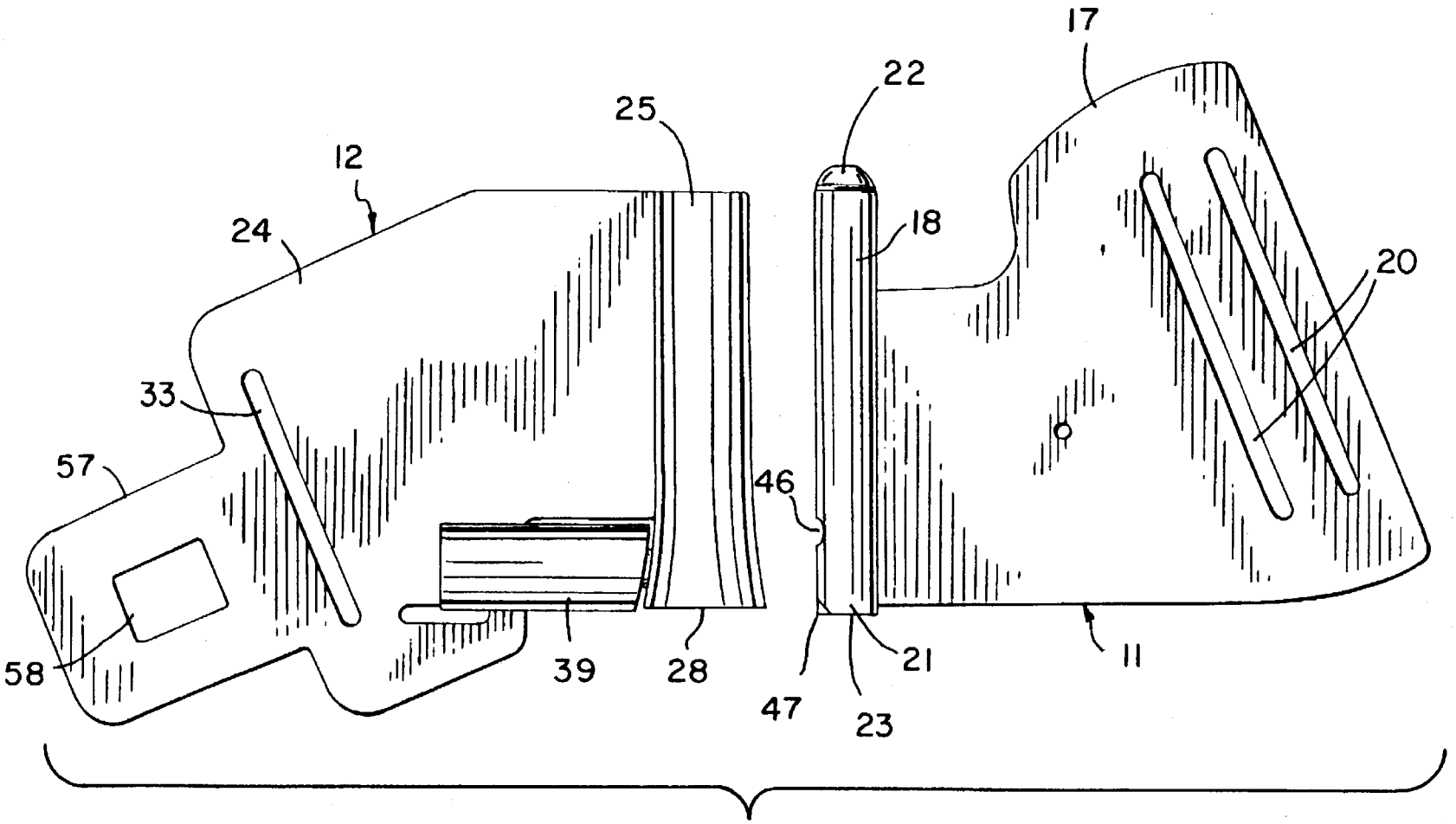
FIG. 4 is a plan view of a modified embodiment of the seat belt buckle of the invention in which one of the buckle sections is adapted to retrofit to a conventional automotive seat belt buckle system.

A modified embodiment of the present invention which is adapted to be retrofitted to existing conventional seat belt systems is shown in FIG. 4. In the buckle system of FIG. 4, the base 24 of the receptacle section 12 is formed with an extending plunger portion 57 with a central opening 58 in it. The plunger portion 57 may be formed integrally with the sheet metal of the base 24. The plunger 57 is designed to fit into the receiver of a conventional automotive seat belt buckle to be locked in place and remain in place during use of the buckle of the present invention. In FIG. 4, the plunger section 11 is shown with the two slots 20, allowing a conventional seat belt to be secured thereto in a desired position on the seat belt, although it is apparent that a conventional receiver portion of a conventional seat belt buckle could be attached to the base 17 of the plunger section, either directly or through a short piece of flexible seat belt connected to the slots 20 and thence to a conventional seat belt receiver. In this manner, a kit may be provided to allow users of vehicles with conventional seat belt buckles to retrofit their systems to incorporate the buckle system of the present invention.

It is understood that the invention is not confined to the embodiments set forth herein as illustrative, but embraces all such modified forms thereof as come within the scope of the following claims.

What is claimed is:

1. An easy to connect and release seat belt buckle comprising:

(a) a plunger section comprising a base, a cylindrical plunger pin mounted to an edge of the base, the plunger pin having a leading end and a diameter which is substantially greater than the thickness of the base, the base suited to be connected to a flexible seat belt;

(b) a receptacle section comprising a base and a receptacle mounted to the base, the receptacle having a cylindrical bore therein with its diameter closely matching the outer diameter of the plunger pin so that the plunger pin can fit closely into the bore of the receptacle, the receptacle having an entrance end and wherein the wall defining the receptacle flares out from the diameter of the receptacle bore which closely matches the diameter of the plunger pin to a larger diameter at the entrance end to facilitate insertion of the plunger pin into the receptacle bore, the wall of the receptacle having a slot therein extending from the entrance opening to a terminal position and sized to admit the plunger base to allow the plunger pin to be inserted into the bore of the receptacle without interference from the base but the slot being substantially smaller than the diameter of the plunger pin so that the plunger pin cannot be withdrawn through the slot, the receptacle section further including detent means thereon for resiliently urging a detent ball against the surface of the plunger pin when the plunger pin is inserted into the bore of the receptacle to assist in holding the plunger pin in place within the bore of the receptacle.

2. The buckle of claim 1 wherein the plunger pin includes an indentation formed in the plunger pin at a position such that the ball of the detent means will fit in the indentation when the plunger pin is inserted fully into the bore of the receptacle.

3. The buckle of claim 1 wherein the detent ball engages an end wall of the plunger pin when the plunger pin is fully engaged in the receptacle.

4. The buckle of claim 3 further including a bevel formed in the plunger pin at the end wall to engage the detent ball to facilitate withdrawal of the pin from the receptacle.

5. The buckle of claim 1 wherein the plunger pin leading end is tapered to facilitate the insertion of the leading end of the plunger pin into the entrance end of the receptacle.

6. The buckle of claim 1 wherein the base of the plunger section is formed of rigid sheet metal and has slots formed therein disposed at an angle to an axis running along the length of the plunger pin and converging toward the leading end side of the plunger pin, the slots formed to admit a seat belt to be threaded therethrough to hold the plunger section adjustably in place on a seat belt, and wherein the base of the receptacle section is formed of rigid sheet metal with a slot therein to admit a flexible seat belt to allow the mounting of the seat belt to the receptacle section.

7. The buckle of claim 1 wherein one of the base of the receptacle section or the base of the plunger section is formed with a plunger plate extending therefrom with a central opening, the plunger plate formed to engage with the receiver of a conventional seat belt thereby to allow the plunger section or receptacle section to be attached to a conventional seat belt.

8. The buckle of claim 1 wherein at least one of the plunger section or receptacle section includes a handle mounted to the base thereof and extending away from the base to allow the handle to be grasped by a hand of a user to facilitate manipulation of the buckle section.

9. An easy to connect and release seat belt buckle comprising:

(a) a plunger section comprising a base, a cylindrical plunger pin mounted to an edge of the base, the plunger pin having a leading end and a diameter which is substantially greater than the thickness of the base, the base suited to be connected to a flexible seat belt;

(b) a receptacle section comprising a base and a receptacle mounted to the base, the receptacle having a cylindrical bore therein with its diameter closely matching the outer diameter of the plunger pin so that the plunger pin can fit closely into the bore of the receptacle, the receptacle having an entrance end and wherein the wall defining the receptacle flares out from the diameter of the receptacle bore which closely matches the diameter of the plunger pin to a larger diameter at the entrance end to facilitate insertion of the plunger pin into the receptacle bore, the wall of the receptacle having a slot therein extending from the entrance opening to a terminal position and sized to admit the plunger base to allow the plunger pin to be inserted into the bore of the receptacle without interference from the base but the slot being substantially smaller than the diameter of the plunger pin so that the plunger pin cannot be withdrawn through the slot, the receptacle section further including detent means thereon for resiliently urging a detent ball against the surface of the plunger pin when the plunger pin is inserted into the bore of the receptacle to assist in holding the plunger pin in place within the bore of the receptacle, wherein the detent means includes a ball mounted in an opening in the bore of the receptacle and having a diameter which is less than the ball so that the ball is held within the opening normally partially extending into the bore of the receptacle, and a case mounted to the receptacle base with a spring mounted therein in compression to urge the ball outwardly against the opening to protrude into the bore of the receptacle, wherein the ball is forced outwardly against the pressure of the spring when the plunger pin is inserted into the bore of the receptacle, whereby frictional pressure is exerted on the plunger pin by the ball resiliently urged against the surface of the plunger pin.

10. An easy to connect and release seat belt buckle comprising:

(a) a plunger section comprising a base, a cylindrical plunger pin mounted to an edge of the base, the plunger pin having a leading end and a diameter which is substantially greater than the thickness of the base, the base suited to be connected to a flexible seat belt;

(b) a receptacle section comprising a base and a receptacle mounted to the base, the receptacle having a cylindrical bore therein with its diameter closely matching the outer diameter of the plunger pin so that the plunger pin can fit closely into the bore of the receptacle, the receptacle having an entrance end, wherein the wall defining the receptacle flares out from the diameter of the receptacle bore which closely matches the diameter of the plunger pin to a larger diameter at the entrance end to facilitate insertion of the plunger pin into the receptacle bore, the wall of the receptacle bore having a slot therein extending from the entrance end to a terminal position and sized to admit the plunger base to allow the plunger pin to be inserted into the bore of the receptacle without interference from the plunger base but substantially smaller than the diameter of the plunger pin so that the plunger pin cannot be withdrawn through the slot, and wherein one of the base of the receptacle section or the base of the plunger section is formed with a plunger plate extending therefrom with a central opening, the plunger plate formed to engage with the receiver of a conventional seat belt thereby to allow the plunger section or receptacle section to be attached to a conventional seat belt.

11. The buckle of claim 10 wherein the receptacle section further includes detent means thereon for resiliently urging a detent ball against the surface of the plunger pin when the plunger pin is inserted into the bore of the receptacle to assist in holding the plunger pin in place within the bore of the receptacle.

12. The buckle of claim 11 wherein the detent ball engages an end wall of the plunger pin when the plunger pin is fully engaged in the receptacle.

13. The buckle of claim 12 further including a bevel formed in the plunger pin at the end wall to engage the detent ball to facilitate withdrawal of the pin from the receptacle.

14. The buckle of claim 10 wherein the plunger pin includes an indentation formed in the plunger pin at a position such that the ball of the detent means will fit in the indentation when the plunger pin is inserted fully into the bore of the receptacle.

15. The buckle of claim 10 wherein the plunger pin leading end is tapered to facilitate the insertion of the leading end of the plunger pin into the entrance end of the receptacle.

16. The buckle of claim 10 wherein the base of the receptacle section is formed of rigid sheet metal and has slots formed therein disposed at an angle to an axis running along the length of the plunger pin and converging toward the leading end side of the plunger pin, the slots formed to admit a seat belt to be threaded therethrough to hold the plunger section adjustably in place on a seat belt, and wherein the base of the receptacle section is formed of rigid sheet metal with a slot therein to admit a flexible seat belt to allow the mounting of the seat belt to the receptacle section.

17. The buckle of claim 10 wherein at least one of the plunger section or receptacle section includes a handle mounted to the base thereof and extending away from the base to allow the handle to be grasped by a hand of a user to facilitate manipulation of the buckle section.

18. An easy to connect and release seat belt buckle comprising:

(a) a plunger section comprising a base, a cylindrical plunger pin mounted to an edge of the base, the plunger pin having a leading end and a diameter which is substantially greater than the thickness of the base, the base suited to be connected to a flexible seat belt;

(b) a receptacle section comprising a base and a receptacle mounted to the base, the receptacle having a cylindrical bore therein with its diameter closely matching the outer diameter of the plunger pin so that the plunger pin can fit closely into the bore of the receptacle, the receptacle having an entrance end, wherein the wall defining the receptacle flares out from the diameter of the receptacle bore which closely matches the diameter of the plunger pin to a larger diameter at the entrance end to facilitate insertion of the plunger pin into the receptacle bore, the wall of the receptacle bore having a slot therein extending from the entrance end to a terminal position and sized to admit the plunger base to allow the plunger pin to be inserted into the bore of the receptacle without interference from the plunger base but substantially smaller than the diameter of the plunger pin so that the plunger pin cannot be withdrawn through the slot, and wherein one of the base of the receptacle section or the base of the plunger section is formed with a plunger plate extending therefrom with a central opening, the plunger plate formed to engage with the receiver of a conventional seat belt thereby to allow the plunger section or receptacle section to be attached to a conventional seat belt, wherein the receptacle section further includes detent means thereon for resiliently urging a detent ball against the surface of the plunger pin when the plunger pin is inserted into the bore of the receptacle to assist in holding the plunger pin in place within the bore of the receptacle, and wherein the detent means includes a ball mounted in an opening in the bore of the receptacle and having a diameter which is less than the ball so that the ball is held within the opening normally partially extending into the bore of the receptacle, and a case mounted to the base with a spring mounted therein in compression against the wall to urge the ball outwardly against the opening to protrude into the bore of the receptacle, wherein the ball is forced outwardly when the plunger pin is inserted into the bore of the receptacle, whereby frictional pressure is exerted on the plunger pin by the ball resiliently urged against the surface of the plunger pin.

19. An easy to connect and release seat belt buckle comprising:

(a) a plunger section comprising a base, a cylindrical plunger pin mounted to an edge of the base, the plunger pin having a leading end and a diameter which is substantially greater than the thickness of the base, the base suited to be connected to a flexible seat belt;

(b) a receptacle section comprising a base and a receptacle mounted to the base, the receptacle having a cylindrical bore therein with its diameter closely matching the outer diameter of the plunger pin so that the plunger pin can fit closely into the bore of the receptacle, the receptacle having an entrance end, the wall of the receptacle having a slot therein extending from the entrance opening to a terminal position and sized to admit the plunger base to allow the plunger pin to be inserted into the bore of the receptacle without interference from the base but the slot being substantially smaller than the diameter of the plunger pin so that the plunger pin cannot be withdrawn through the slot, the receptacle section further including a detent ball mounted in an opening in the bore of the receptacle and having a diameter which is less than the ball so that the ball is held within the opening normally partially extending into the bore of the receptacle, and a case mounted to the receptacle base with a spring mounted therein in compression to urge the ball outwardly against the opening to protrude into the bore of the receptacle, wherein the ball is forced outwardly against the pressure of the spring when the plunger pin is inserted into the bore of the receptacle, whereby frictional pressure is exerted on the plunger pin by the ball resiliently urged against the surface of the plunger pin.

20. The buckle of claim 19 wherein the plunger pin includes an indentation formed in the plunger pin at a position such that the ball of the detent means will fit in the indentation when the plunger pin is inserted fully into the bore of the receptacle.

21. The buckle of claim 19 wherein the detent ball engages an end wall of the plunger pin when the plunger pin is fully engaged in the receptacle.

22. The buckle of claim 21 further including a bevel formed in the plunger pin at the end wall to engage the detent ball to facilitate withdrawal of the pin from the receptacle.

* * * * *